US005222532A

United States Patent [19]

Janssen et al.

[11] Patent Number: 5,222,532

[45] Date of Patent: Jun. 29, 1993

[54] DEVICE FOR DISPENSING HYDROCARBONS WITH VAPOR RECOVERY

[75] Inventors: Sylvain Janssen, Neuilly s/Seine; Jacques Fournier, Bretigny S/Orge; Claude Fouinaud, Montrouge, all of France

[73] Assignee: Schlumberger Industries, Montrouge, France

[21] Appl. No.: 821,795

[22] Filed: Jan. 16, 1992

[30] Foreign Application Priority Data

Jan. 21, 1991 [FR] France ..... 91 00638

[51] Int. Cl.[5] ..... B65D 3/18

[52] U.S. Cl. ..... 141/59; 141/98; 141/84; 141/46; 141/311 R

[58] Field of Search ..... 141/46, 59, 98, 1, 84, 141/311 R; 184/6, 29; 137/88, 109

[56] References Cited

U.S. PATENT DOCUMENTS

| | | | |
|---|---|---|---|
| 4,082,122 | 4/1978 | McGahey | 141/59 X |
| 4,098,308 | 7/1978 | Purdum | 141/285 |
| 4,197,883 | 4/1980 | Mayer | 141/59 |
| 4,202,385 | 5/1980 | Voelz et al. | 141/59 |
| 4,260,000 | 4/1981 | McGahey | 141/59 |
| 4,566,504 | 1/1986 | Furrow et al. | 141/59 |
| 5,150,742 | 9/1992 | Motohashi et al. | 141/59 |
| 5,156,199 | 10/1992 | Hartsell, Jr. et al. | 141/83 |

FOREIGN PATENT DOCUMENTS 1582585 1/1981 United Kingdom .

*Primary Examiner*—Ernest G. Cusick

*Attorney, Agent, or Firm*—Frishauf, Holtz, Goodman & Woodward

[57] ABSTRACT

A lubricating system for the pump of the vapor recovery circuit of a nozzle for dispensing a hydrocarbon. The lubricating system comprises a capillary pipe which takes off a small flow of hydrocarbon from the main pump of the feedpipe and feeds it to the inlet of the vapor recovery pump.

5 Claims, 2 Drawing Sheets

DEVICE FOR DISPENSING HYDROCARBONS WITH VAPOR RECOVERY

The present invention relates to a device for dispensing hydrocarbons with vapor recovery.

More particularly, the present invention relates to a system for lubricating the pump of the vapor recovery circuit in a device for dispensing hydrocarbons with vapor recovery.

BACKGROUND OF THE INVENTION

It is known that, for environmental reasons and comfort of users of gasoline pumps, there is an ever greater tendency to fit, or endeavor to fit hydrocarbon dispensers with systems for recovering and recycling the hydrocarbon vapors released into the atmosphere while filling vehicle tanks.

For effective systems it is necessary to provide pump means in the vapor recovery circuit to assist the transfer of the gaseous substances through the flexible hoses and the dispensing nozzle, which have non-negligible head-losses.

Vapor recovery pumps are subjected to particularly severe operating conditions, which explains the difficulties encountered in their development and the frequent breakdowns occurring with those vapor recovery system that do exist.

Thus the fluid conveyed by aspiration of vapors comprises a mixture of more or less dry air, gaseous hydrocarbons which may condense, as well as dust particles and possibly saline mist. As a result, because of the absence of hydrocarbons in liquid form, the moving parts of the pump are not lubricated, and the gaseous mixture may additionally be corrosive.

Furthermore, to obtain a pumping rate and good volumetric output from the pump at all speeds, it is necessary to have close contact between the various moving parts of the pump, i.e. good sealing between these parts. Moreover, attempts to achieve this sealing and the adjustments effected may lead to non-negligible heating of some of the parts, creating further problems.

To solve these problems it would be necessary for the pump to be lubricated continuously. It will be understood that it is not possible to lubricate such a pump with a more or less viscous oil. In fact such lubricating oil would finish up at the end of the vapor recovery channel in the tank containing the hydrocarbons which are subsequently pumped out to dispense hydrocarbon to the user.

It is an object of the invention to provide a system for recovering vapor in which the pump is effectively and continuously lubricated under acceptable conditions as regarding the lubricating fluid and which moreover does not involve additional energy consumption.

SUMMARY OF THE INVENTION

To achieve this object, the hydrocarbon dispensing device with vapor recovery according to the invention comprises a dispensing nozzle, a hydrocarbon feed circuit including a hydrocarbon feed pipe connected to the nozzle and in which a hydrocarbon pump is fitted, and it further comprises a vapor recovery pipe discharging into a hydrocarbon storage tank, a vapor recovery pump fitted in said vapor recovery pipe, and a lubricating pipe with a calibrated pressure drop to feed a flow q of hydrocarbon continuously, from the feed circuit to said vapor recovery pump, when the dispenser is in operation.

It will be understood that the vapor recovery pump is thus lubricated by the liquid hydrocarbon, itself taken from the feed circuit. The mixture which is returned to the storage tank accordingly only comprises hydrocarbons in liquid or gaseous form and thus does not alter the composition of the mixture dispensed to users.

In a first embodiment, the lubricating pipe connects the hydrocarbon pump to the vapor recovery pump. The higher pressure in the feed pump is enough to effect lubrication of the vapor recovery pump.

In a second embodiment, the lubricating pipe connects a de-aeration tank to the inlet of the vapor recovery pump.

Since the de-aeration tank is at substantially atmospheric pressure, the suction which exists at the inlet to the vapor recovery pump is enough to make the lubricating hydrocarbon flow.

BRIEF DESCRIPTION OF THE DRAWINGS

Embodiments of the invention are described by way of example with reference to the accompanying drawings, in which.

DETAILED DESCRIPTION

Figure 1:
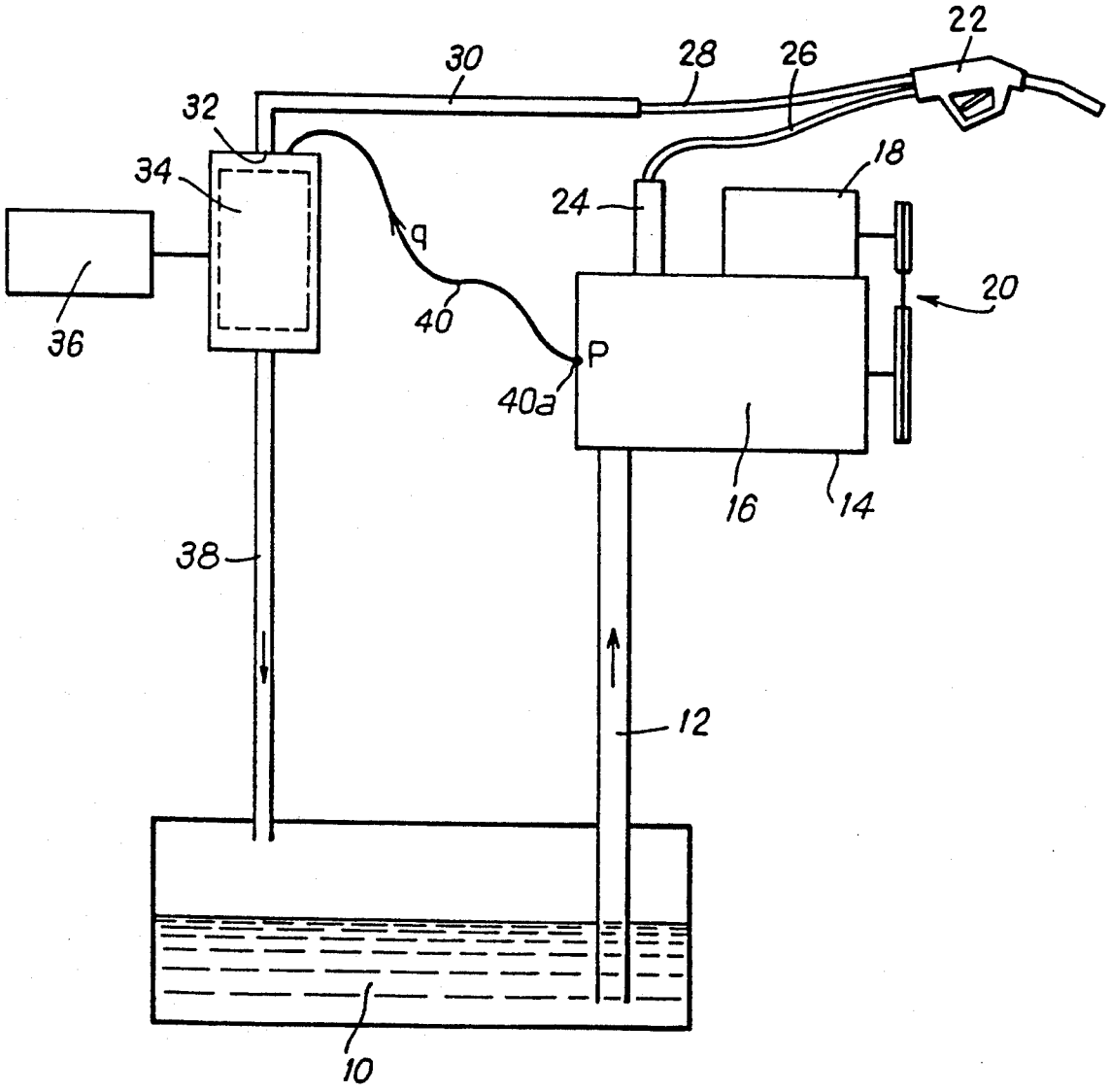
FIG. 1 is a simplified diagram of a hydrocarbon dispensing device with a first embodiment of the lubricating circuit.

Referring initially to FIG. 1, a first embodiment of the hydrocarbon dispensing device is described with its lubricating system for the vapor recovery pump.

In well known manner, the device comprises a hydrocarbon storage tank 10, and a hydrocarbon take-off pipe 12 in the tank 10, this pipe 12 feeding into the housing 14 of a hydrocarbon feed pump 16. This pump may be of any suitable kind, such as a gear pump as is well known in the technical field in question.

The pump 16 is associated with a motor 18 which drives the pump 16 though a pulley and belt system 20. The output of the pump 16 is connected to the hydrocarbon dispensing nozzle 22 by a pipe 24 and a hose 26 connected to the nozzle 22. Furthermore, as is well known in hydrocarbon dispensing systems with vapor recovery, a second pipe 28 is connected to the nozzle 22 and to the vapor recovery pipe 30. The pipe 30 is connected to the inlet port 32 of a pump 34, for example of the gear or vane type, the pump 34 being driven by the motor 36. The mixture of vapors drawn off by the pump 34 is returned to the storage tank 10 through a pipe 38.

The above description describes a conventional hydrocarbon dispensing system with vapor recovery, in which the recovery pump 34 is not lubricated.

In accordance with the invention, a capillary pipe 40 connects housing 14 of the hydrocarbon feed pump 16 to the housing of the vapor recovery pump 34. It will be understood that the end 40*a* of the pipe 40 connecting into the feed pump housing 14 is at a pressure P which is in the order of 1.5 bar to 4 bar, when the dispenser is in operation.

Experience has shown that the flow of hydrocarbon provided by the pipe 40 to the vapor recovery pump 34 should be in the order of 1 cc per minute. Under normal operating conditions (several bars pressure and a liquid of low viscosity, such as unleaded premium grade gasoline), the effective flow q may be very much greater than 1 cc per minute if capillary tubes of prevailing dimensions are used. To remedy this, with an inside diameter in the order of 0.5 mm and a length in the order of 0.5 m, a wire of diameter less than 0.5 mm is slipped into the inside of the tube, which leads to an appreciable increase in its internal resistance. This can be explained as follows.

The most common smallest industrial capillary pipes have an inside diameter of about 0.5 mm. If a pressure difference $\Delta P$ is applied on its extremities, a volumetric fluid flow $q_v$ will be established, and Poiseuille's formula gives the following relation between the parameters, provided the Reynolds Number stays below 2000:

$$q_v = \frac{\pi \cdot d^4 \cdot \Delta P}{128 \cdot \mu \cdot l}$$

wherein $q_v$=volume flow
d=pipe diameter
$\Delta P$=pressure difference
$\mu$=fluid viscosity
l=pipe length If for instance $\Delta P = 31$ mbar$=310^3$ Pa
d=0.5 mm$=510^{-4}$m
$\mu$=0.5 centipoise$=510^{-4}$Pa·s
l=1 m $q_v$ will be $q_v=910^{-9}m^3/s=0.54$ cm$^3$/min and an inside diameter of about d=0.6 mm would give the right (desired) value of $q_v$=1 cm$^3$/min. flow.

But, if $\Delta P$ is in the order of 3 bar, one cannot solve the problem without slipping a wire inside 0.5 mm pipe, as flow would be too high (i.e. 54 cm$^3$/min). Slipping a wire of diameter $d_1$ inside a capillary pipe diameter $d_2$ will increase the hydraulic resistance, and Poiseuille's formula becomes:

$$q_v = \frac{\pi \cdot (d_1 - d_2)^3 \cdot (d_1 + d_2) \cdot \Delta P}{192 \cdot \mu \cdot l}$$

For instance if $\Delta P$ =3 bar$=310^5$Pa
$\mu=510^{-3}$ Poise $=510^{-4}$Pa·s
l =lm
$d_1$=0.5 mm$\approx 510^{-4}$m
$d_2$=0.4 mm$\approx 410^{-4}$m then $q_v$=0.53 cm$^3$/min.

So, it is always possible to obtain a flow in the order of 1 cm$^3$/min. by adjusting length, pipe and wire diameter.

It will be understood that the hydrocarbon fed to the vapor recovery pump thus lubricates the various parts in mutual contact, through the friction between the various moving parts, which enables the problem of wear, overheating and sealing to be resolved simultaneously.

Figure 2:
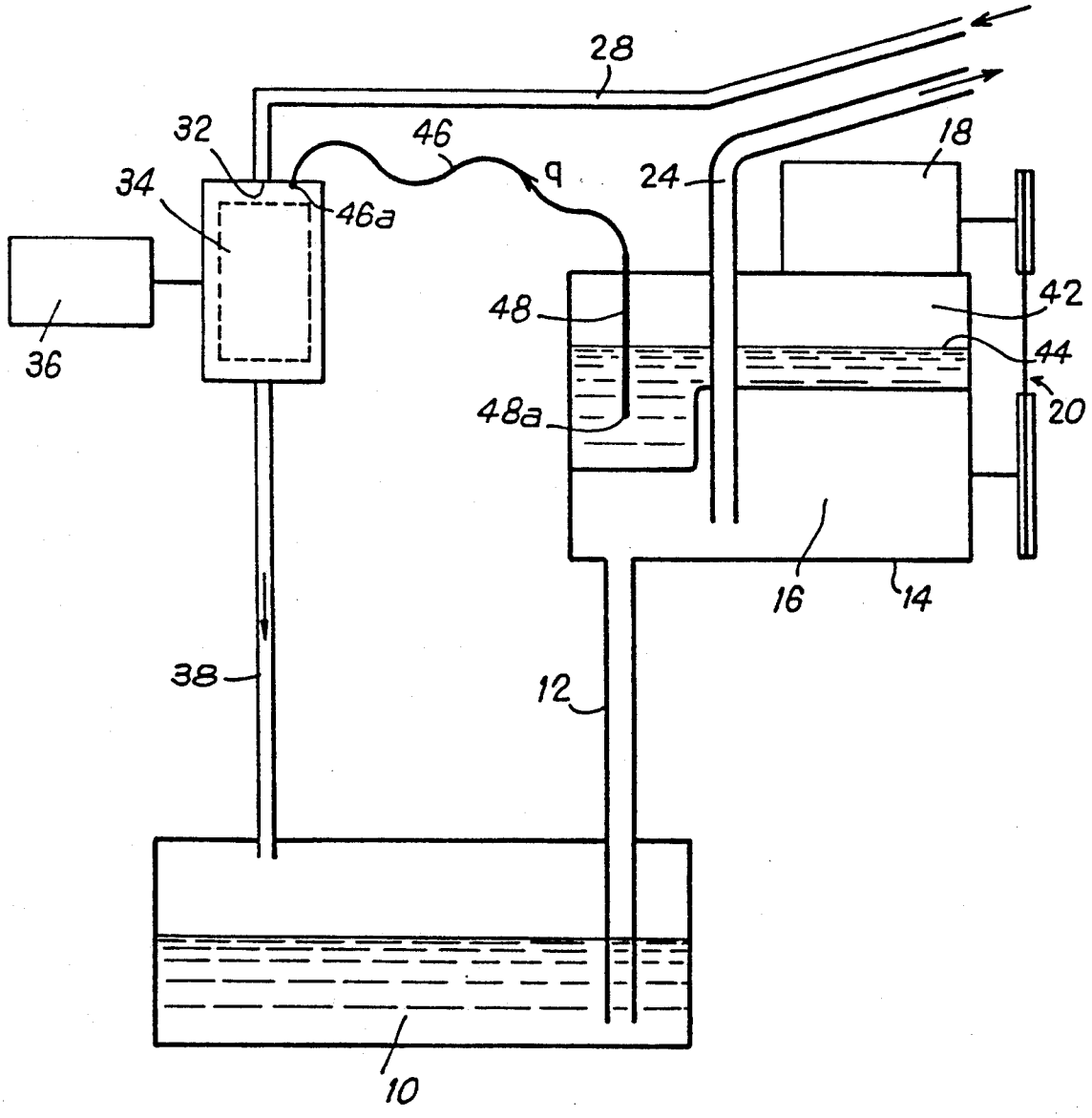
FIG. 2 is a similar diagram to FIG. 1 showing a second embodiment of the lubricating circuit.

Referring now to FIG. 2, a second embodiment of the invention is described. In FIG. 2, the vapor recovery circuit is identical to that in FIG. 1 and it will thus not be described again. As to the hydrocarbon feed circuit, there is only the addition of a hydrocarbon de-aeration tank 42, which is located above the pump 16. As is known, the de-aeration tank 42 is fed by a small flow taken from the hydrocarbon feed and the pressure in the tank is maintained at atmospheric pressure. In other words, atmospheric pressure reigns above the level 44 of hydrocarbons contained in the tank 42.

In this second embodiment the lubricating pipe 46 connects the de-aeration tank 42 by way of the tube 48 dipping into the hydrocarbon to the inlet region 32 of the vapor recovery pump 34. In the same manner, the tube 46 is a calibrated tube to ensure a hydrocarbon flow in the order of 1 cc per minute. In this case it will be understood that a pressure substantially equal to atmospheric pressure reigns at the open end 48*a* of the tube 48. However, as the end 46*a* of the pipe 46 opens into the suction region of the pump 34, a slight pressure drop is present in this region when the pump 34 is in operation, which is enough to drive the flow q of hydrocarbons along the pipe 46 and thus to ensure lubrication of the pump 34 under the conditions explained in relation to FIG. 1.

In this embodiment, the pressure difference between the open end of the tube 46*a* and the end 48*a* is only in the order of 30 millibar. This pressure should be compared with the pressure P used in the first embodiment, which is preferably approximately 3 bar. It is necessary to take this value of the pressure difference into account in determining the diameter of the pipe 46. This can be done in the same way as described above for the first embodiment. It will be understood that the pressure drop at the suction region of the pump 34 is a function of the speed of rotation of the pump 34. It will also be understood that the greater the speed of rotation of the pump, the greater the hydrocarbon flow serving to lubricate the pump, which is clearly advantageous for good operation of the vapor recovery pump 34.

It follows from the preceding description that, because of its lubricated device, the vapor recovery pump 34 can operate under optimum conditions since it is lubricated by the liquid hydrocarbon which is itself in sufficient quantity. Furthermore the mixture returned to the storage tank is only modified by the addition of hydrocarbons which clearly has no effect on the composition of the hydrocarbon which is taken by the feed system from this same tank.

Finally it should be emphasized that the lubricating hydrocarbon flow involves hardly any additional energy consumption, since this flow is very small and this fraction of the hydrocarbon flow is caused to flow under the effect of a pressure differential pre-existing in the hydrocarbon dispenser.

We claim:

1. A device for dispensing hydrocarbons with vapor recovery, comprising a dispensing nozzle, a feed circuit including a hydrocarbon feed pipe in which a hydrocarbon pump is fitted, wherein said device further comprises a vapor recovery pipe discharging into a hydrocarbon storage tank, a vapor recovery pump fitted in said recovery pipe, and a lubricating pipe with a calibrated pressure drop to feed a flow q of hydrocarbon from said feed circuit to said vapor recovery pump.

2. A device according to claim 1, wherein said lubricating pipe connects the hydrocarbon pump to the vapor recovery pump.

3. A device according to claim 1 in which said feed circuit further comprises a de-aeration chamber, wherein said lubricating pipe connects said de-aeration chamber to the inlet of said vapor recovery pump.

4. A device according to claim 1, wherein said lubricating pipe is constituted by a capillary tube having an inside diameter in the order of 0.5 mm.

5. A device according to claim 1, wherein said hydrocarbon flow q for lubrication is in the order of 1 cc per minute.

* * * * *